US009957135B2

(12) United States Patent
Alasentie et al.

(10) Patent No.: US 9,957,135 B2
(45) Date of Patent: May 1, 2018

(54) ELEVATOR

(71) Applicant: KONE CORPORATION, Helsinki (FI)

(72) Inventors: Pentti Alasentie, Espoo (FI); Johannes De Jong, Järvenpää (FI)

(73) Assignee: KONE CORPORATION, Helsinki (FI)

( * ) Notice: Subject to any disclaimer, the term of this patent is extended or adjusted under 35 U.S.C. 154(b) by 729 days.

(21) Appl. No.: 14/314,689

(22) Filed: Jun. 25, 2014

(65) Prior Publication Data

US 2014/0305745 A1 Oct. 16, 2014

Related U.S. Application Data

(63) Continuation of application No. PCT/FI2013/050033, filed on Jan. 11, 2013.

(30) Foreign Application Priority Data

Jan. 25, 2012 (FI) ..... 20125078

(51) Int. Cl.
*B66B 7/06* (2006.01)
*B66B 9/00* (2006.01)
(Continued)

(52) U.S. Cl.
CPC ..... *B66B 7/062* (2013.01); *B66B 9/00* (2013.01); *B66B 11/009* (2013.01); *D07B 1/162* (2013.01); *D07B 1/165* (2013.01); *D07B 1/025* (2013.01); *D07B 1/22* (2013.01); *D07B 2201/2016* (2013.01); *D07B 2201/2046* (2013.01); *D07B 2201/2071* (2013.01);
(Continued)

(58) Field of Classification Search
CPC ..... B66B 11/009
See application file for complete search history.

(56) References Cited

U.S. PATENT DOCUMENTS

2008/0223665 A1 9/2008 O'Donnell
2009/0120733 A1 5/2009 Mustalahti et al.
(Continued)

FOREIGN PATENT DOCUMENTS

CN 2723404 Y 9/2005
CN 101506083 A 8/2009
(Continued)

OTHER PUBLICATIONS

Machine Translation of FR 2823734.*

*Primary Examiner* — William E Dondero
*Assistant Examiner* — Diem M Tran
(74) *Attorney, Agent, or Firm* — Birch, Stewart, Kolasch & Birch, LLP

(57) ABSTRACT

An elevator includes an elevator car, a counterweight and suspension roping, which connects the elevator car and counterweight to each other, and which suspension roping includes one or more ropes, which include a load-bearing composite part, which includes reinforcing fibers in a polymer matrix. The elevator car and the counterweight are arranged to be moved by exerting a vertical force on at least the elevator car or on the counterweight. The elevator includes a device separate from the suspension roping for exerting the force on at least the elevator car or on the counterweight.

19 Claims, 2 Drawing Sheets

(51) Int. Cl.

| | |
|---|---|
| ***B66B 11/00*** | (2006.01) |
| ***D07B 1/16*** | (2006.01) |
| *D07B 1/02* | (2006.01) |
| *D07B 1/22* | (2006.01) |

(52) U.S. Cl.
CPC ..... *D07B 2205/205* (2013.01); *D07B 2205/2014* (2013.01); *D07B 2205/2046* (2013.01); *D07B 2205/2096* (2013.01); *D07B 2205/3003* (2013.01); *D07B 2205/3007* (2013.01); *D07B 2501/2007* (2013.01)

(56) References Cited

U.S. PATENT DOCUMENTS

| | | | | |
|---|---|---|---|---|
| 2014/0231179 | A1* | 8/2014 | Alasentie | B66B 11/0045 187/251 |
| 2014/0231180 | A1* | 8/2014 | Kallioniemi | B66B 11/0045 187/256 |

FOREIGN PATENT DOCUMENTS

| | | | |
|---|---|---|---|
| EP | 1 199 276 | A1 | 4/2002 |
| EP | 1 367 017 | A1 | 12/2003 |
| EP | 1493708 | A2 | 1/2005 |
| EP | 1 612 179 | A1 | 1/2006 |
| JP | 9-40322 | A | 2/1997 |
| WO | WO 98/29327 | A1 | 7/1998 |
| WO | WO 99/43600 | A1 | 9/1999 |
| WO | WO 03/043927 | A2 | 5/2003 |
| WO | WO 2009/090299 | A1 | 7/2009 |
| WO | WO 2011/135174 | A1 | 11/2011 |
| WO | WO 2011/148033 | A1 | 12/2011 |

* cited by examiner

ELEVATOR

CROSS REFERENCE TO RELATED APPLICATIONS

This application is a continuation of PCT International Application No. PCT/FI2013/050033 filed on Jan. 11, 2013, which claims priority under 35 U.S.C 119(a) to Application No. 20125078 filed on Jan. 25, 2012 in Finland, all of which are hereby expressly incorporated by reference into the present application.

FIELD OF THE INVENTION

The object of the invention is an elevator, which is preferably an elevator applicable to passenger transport and/or freight transport.

BACKGROUND OF THE INVENTION

The invention relates to the suspension of an elevator car of an elevator and to producing lifting force for the elevator car. The ropes of the suspension roping of elevators have conventionally been manufactured from metal. Known in the art are also elevators in which is used hoisting roping comprising ropes having a force-transmission capability based on light fibers, such as glass fibers or carbon fibers, in essentially the longitudinal directions of the rope. This type of solution is presented in, inter alia, publication WO 2009090299. In the solution the rope has (a) load-bearing composite part(s), which composite part comprises reinforcing fibers in a polymer matrix. Another problem of composite solutions has been that composite parts do not bend well around a small diverting pulley. That being the case also the suspending rope pulleys and the traction sheave have been large in diameter. Owing to a large traction sheave, the dimensioning of the motor of the machine to be of a small size has been hampered by the large torque required of the motor. Owing to costs and size increase, a gear has not been desired for the machine either. That being the case, the aforementioned structure of the suspension ropes has resulted in a machine that is large in size. Additionally, the aforementioned types of ropes withstand the forces exerted on the surface of the rope worse than conventional metal ropes. Metal ropes withstand e.g. impacts, incisions and abrasion well. To eliminate these problems, ropes of a more brittle material are coated with polyurethane or with some other elastic coating. Yet another problem in coated composite ropes is the long-term permanence of attachment of the coating to a rigid load-bearing part, more particularly in solutions in which lifting force is transmitted via the coating or frequently repeated braking is transmitted to the roping via a rotating traction means, because in these functions sudden shearing forces are produced between the thin coating and the generally smooth composite. This can result in local detachment of the coating and the composite from each other. Likewise, configuring the friction coefficient to be suitably large within certain limits has been challenging.

BRIEF DESCRIPTION OF THE INVENTION

The aim of the present invention is to solve the aforementioned problems of prior-art solutions as well as the problems disclosed in the description of the invention below. The aim is therefore to produce an elevator, the movement of the elevator car of which can be produced effectively and without problem in an elevator having suspension roping comprising a load-bearing composite part. Among other things, embodiments are disclosed which have elevator suspension roping that is light, strong and rigid. Among other things, embodiments are disclosed which have elevator suspension roping that can be formed to be based in its tensile strength on fibers that are not intertwined with each other.

The invention is based on the concept of forming the suspension roping of an elevator to be such that the longitudinal load-bearing capacity of the rope or ropes of it is achieved with a composite structure, and force is transmitted to the entity comprised of the elevator car, the counterweight and the suspension roping for moving this entity by exerting a moving force on another part of the entity than the suspension roping, which is particularly advantageous when a fiber-reinforced composite rope is the rope involved. In this way the structure of the suspension roping can be appreciably optimized from the viewpoint of the lightness of its structure and of the capacity for supporting the elevator car and the counterweight (withstanding tension in the longitudinal direction of the rope between them without breaking).

An embodiment, inter alia, is disclosed having the advantage that when using traction ropes, not much tension is exerted on them, e.g. not as large a load as on the suspension ropes. Thus the structure of them can be dimensioned to be light, so that even if the material of them were heavy, e.g. metal, such a small number of them is needed that the addition to the moving masses of the elevator caused by their weight is still kept reasonable.

The elevator according to the invention comprises an elevator car, a counterweight, suspension roping, which connects the aforementioned elevator car and counterweight to each other, and which suspension roping comprises one or more ropes, which comprises a load-bearing composite part, which comprises reinforcing fibers in a polymer matrix. The elevator car and the counterweight are arranged to be moved by exerting a vertical force on at least the elevator car or on the counterweight. The elevator comprises means separate from the suspension roping for exerting the aforementioned force on at least the elevator car or on the counterweight.

Preferably the module of elasticity of the aforementioned polymer matrix is at least 2 GPa. In this way the strength and the rigidity properties of the composite rope both in tension and in bending are advantageous. The matrix is thus advantageous from the viewpoint of the support of the fibers and the distribution of forces. The force transmission disclosed in connection with the composite rope possessing this type of structure is particularly advantageous.

Preferably the elevator comprises a rope pulley (preferably in the proximity of the top end of the path of movement of the elevator car), while supported on which the rope/ropes of the suspension roping support the elevator car and the counterweight, preferably with a 1:1 suspension or alternatively with a 2:1 suspension.

Preferably the rope pulley is a non-driven rope pulley. In this way space is not taken by the machine in addition to the large diverting pulley required by a rigid composite rope. On the other hand, one advantage is that abundant unwanted stresses are not exerted in normal use on the composite ropes.

Preferably the rope pulley is out of the path of movement of the elevator car, and the suspension roping is supported on the side of the elevator car. In its top position therefore the elevator car can be situated alongside the rope pulley.

Preferably the density of the reinforcing fibers is less than 4000 kg/m3. When these types of reinforcing fibers are selected, the rope can be formed to be light. Some commercially available fiber can be used as the fibers.

Preferably the strength of the reinforcing fibers is over 1500 N/mm2. The force-transmission capability of the fibers is thus sufficient for a strong suspension rope of the elevator to be compactly achieved from it.

Preferably the aforementioned reinforcing fibers are non-metallic. Thus the suspension is light.

Preferably the aforementioned reinforcing fibers are carbon fibers, glass fibers, aramid fibers or polymer fibers (polymer fibers can be preferably polybenzoxazole fibers or polyethylene fibers, such as UHMWPE fibers, or nylon fibers or corresponding) or a combination of these. These fibers are light, in which case the suspension can be made to be lightweight.

In one embodiment the aforementioned load-bearing part or plurality of load-bearing parts 12 is surrounded with a coating layer p, which layer forms the surface of the rope. The coating p is preferably an elastomer, most preferably a high-friction elastomer such as preferably polyurethane. When the coating layer is thin, as it is in the case of the embodiments presented, the force transmission to the elevator car presented is advantageous because keeping a thin coating attached to the composite would be jeopardized as a consequence of the repeated force transmission in the longitudinal direction of the rope exerted via the surface.

Preferably the reinforcing fibers, preferably essentially all the fibers of the force-transmitting part, are essentially uninterlaced in relation to each other. A so-called braiding is not, therefore, in question here. In this way an advantage, among others, of straight fibers longitudinal to the rope is the rigid behavior and small relative movement/internal wear of the force-transmitting part formed by them. In this way creep is minor and a rope that can be formed to be light is also able to quickly stop a counterweight endeavoring to continue its movement.

Preferably the means for exerting the aforementioned force on at least the elevator car or on the counterweight comprise traction roping, which is connected to the elevator car and/or to the counterweight, and a hoisting machine, which comprises means for moving the traction roping, which means preferably comprise a rotating device (e.g. a motor) and a traction means to be rotated. In this case force transmission can be executed simply, e.g. using more widespread force transmission solutions for an elevator. Force transmission and suspension in this case can both be based on the rope suspension, but the suspension roping is appreciably optimized from the viewpoint of its suspension properties and the structure of the traction roping can be optimized on the basis of other considerations.

Preferably the suspension roping is connected to the elevator car and to the counterweight such that when the elevator car moves upwards the counterweight moves downwards, and vice versa, and the suspension roping travels over the top of a rope pulley that is supported in its position.

Preferably the hoisting machine is disposed in the proximity of the bottom end of the path of movement of the elevator car. Thus it is very accessible in connection with installation and servicing. It is quick to install and does not increase the size of the structure of the top parts of the elevator. Preferably the hoisting machine is disposed in the elevator hoistway in the proximity of the bottom end of the path of movement of the elevator car. Thus a separate space is not needed for it. It can be supported e.g. on the base of the elevator hoistway or between the wall of the elevator hoistway and the path of movement of the elevator car (e.g. on the wall structures of the elevator hoistway).

Preferably the hoisting machine is arranged to exert via the traction roping a downward pulling force on the elevator car or on the counterweight. Thus exerting with the hoisting machine a vertically downward pulling force on the elevator car or on the counterweight for acting on the force imbalance between them, and thereby for adjusting the movement of them, can be arranged. By exerting a downward-pulling force on the counterweight, the elevator car can be moved upwards and the counterweight downwards, or otherwise downward movement of the elevator car can be braked. By exerting a downward-pulling force on the elevator car, the elevator car can be moved downwards and the counterweight upwards, or otherwise the upward movement can be braked.

Preferably the traction roping is suspended to hang from the elevator car and/or from the counterweight. Thus downward pulling of the elevator unit in question can be implemented in practice simply.

In one embodiment the traction roping comprises one or more ropes, which comprise a force-transmitting part or force-transmitting parts, which part is a braiding/which parts are braidings. The rope of the traction roping can thus be formed cheaply with conventional technology, and to bend with a small radius. The braiding can comprise metal fibers or e.g. aramid fibers. The rope can in this case be a braided steel rope or a belt, inside which is one or more steel braidings or aramid braidings.

In one embodiment the traction roping comprises one or more ropes, the longitudinal force-transmission capability of which is based at least essentially on metal wires in the longitudinal direction of the rope, preferably the rope is steel rope or a belt, inside which is one or more steel braidings. A rope intended for traction can in this case be some commercially available rope. Traction can thus be arranged cheaply and to be durable.

Preferably the rope comprises a load-bearing part or a plurality of load-bearing parts, for transmitting force in the longitudinal direction of the rope, which force-transmitting part is essentially fully of non-metallic material.

Preferably each aforementioned the load-bearing part continues from the elevator car at least to the counterweight and the rope is arranged to transmit with each aforementioned load-bearing part a force in the longitudinal direction of the rope between the elevator car and the counterweight.

Preferably the elevator car and the counterweight hang supported by the aforementioned load-bearing part/load-bearing parts.

Preferably essentially all the load-bearing parts of the rope are essentially fully of non-metallic material.

Preferably the aforementioned reinforcing fibers are non-metallic synthetic fibers.

Preferably the module of elasticity of the aforementioned polymer matrix is over 2 GPa, most preferably over 2.5 GPa, even more preferably in the range 2.5-10 GPa, most preferably of all in the range 2.5-3.5 GPa. In this way a structure is achieved wherein the matrix strongly supports the reinforcing fibers, e.g. against buckling. One advantage, among others, is a longer service life.

Preferably the density of the aforementioned reinforcing fibers is less than 4000 kg/m3. Preferably the density of the fibers is less than 4000 kg/m3, and the strength is over 1500 N/mm2, more preferably so that the density of the aforementioned fibers is less than 4000 kg/m3, and the strength is over 2500 N/mm2, most preferably so that the density of the aforementioned fibers is less than 3000 kg/m3, and the strength is over 3000 N/mm2. One advantage is that the fibers are light, and not many of them are needed owing to their great strength. The aforementioned strength is understood with brittle materials to mean breaking strength and with other materials to mean yield strength.

Preferably at least 50% of the surface area of the cross-section of (each) aforementioned load-bearing part is reinforcing fiber. In this way the longitudinal properties of the load-bearing part are advantageous.

Preferably the aforementioned load-bearing part or aforementioned load-bearing parts together cover over 40% of the surface area of the cross-section of the rope, preferably 50% or over, even more preferably 60% or over, even more preferably 65% or over. In this way a large part of the cross-sectional area of the rope can be formed to be load bearing.

Preferably the aforementioned load-bearing part or aforementioned load-bearing parts together cover most of the width of the cross-section of the rope for essentially the whole length of the rope. Preferably the load-bearing part(s) thus cover(s) 60% or over, more preferably 65% or over, more preferably 70% or over, more preferably 75% or over, most preferably 80% or over, most preferably 85% or over, of the width of the cross-section of the rope. Thus the force-transmission capability of the rope with respect to its total lateral dimensions is good, and the rope does not need to be formed to be thick.

Preferably the rope comprises a plurality, preferably at least two, three or four, or more, of the parallel load-bearing parts.

Preferably the individual reinforcing fibers are evenly distributed into the aforementioned matrix. Thus the structure of the load-bearing part can be formed to be homogeneous and the matrix can make contact with all, or essentially all, the fibers.

Preferably the polymer matrix is a non-elastomer. Preferably the polymer matrix is not rubber or polyurethane. Thus the matrix essentially supports the reinforcing fibers.

Preferably the polymer matrix comprises epoxy, polyester, phenolic plastic or vinyl ester. In this way a structure is achieved wherein the matrix essentially supports the reinforcing fibers. One advantage, among others, is a longer service life and the enablement of smaller bending radiuses.

Preferably the rope does not comprise such a quantity of metal wires that together they would form an essential part of the longitudinal force-transmission capability of the rope. In this way essentially the whole longitudinal force transmission of the rope can be arranged with a non-metallic material alone.

Preferably the individual reinforcing fibers are evenly distributed into the aforementioned matrix. The composite part of the force-transmitting part, which is even in its material properties and has a long life, is effectively reinforced with fibers.

Preferably the aforementioned reinforcing fibers are at least essentially continuous fibers in the longitudinal direction of the rope, which fibers preferably continue for essentially the distance of the whole length of the rope. The structure thus formed is rigid and easy to form.

Preferably the suspension roping comprises one or more ropes of essentially belt shape in their cross-section. Preferably the width/thickness of the rope is at least 2 or more, preferably at least 4, even more preferably at least 5 or more, even more preferably at least 6, even more preferably at least 7 or more, even more preferably at least 8 or more, possibly more than 10. In this way good force-transmission capability is achieved with a small bending radius.

In one embodiment of the invention the aforementioned reinforcing fibers are carbon fibers. Thus the elevator is fireproof and energy-efficient and the rope is rigid.

In one embodiment of the invention the aforementioned reinforcing fibers are glass fibers. Thus the elevator is fireproof, energy-efficient and inexpensive, but nevertheless the rope is reasonably rigid.

In one embodiment the suspension roping is connected to the elevator car and to the counterweight with a 1:1 suspension ratio, and the traction roping is connected to the elevator car and to the counterweight with a 2:1 suspension ratio.

Preferably the suspension roping and the traction roping comprise ropes that are different to each other in their material and/or in their cross-section. In this way the structure of the roping can be optimized according to its function. For example, the grip, price and weight of the ropings can thus be optimized.

The elevator is most preferably an elevator applicable to the transporting of people and/or of freight, which elevator is installed in a building, to travel in a vertical direction, or at least in an essentially vertical direction, preferably on the basis of landing calls and/or car calls. The elevator car preferably has an interior space, which is most preferably suited to receive a passenger or a number of passengers. The elevator preferably comprises at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1:
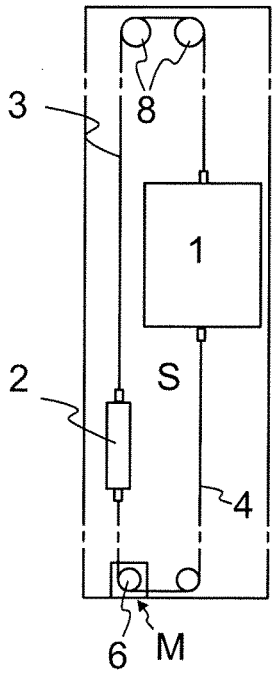
FIG. 1 presents an elevator according to a first embodiment of the invention.
Figure 2:
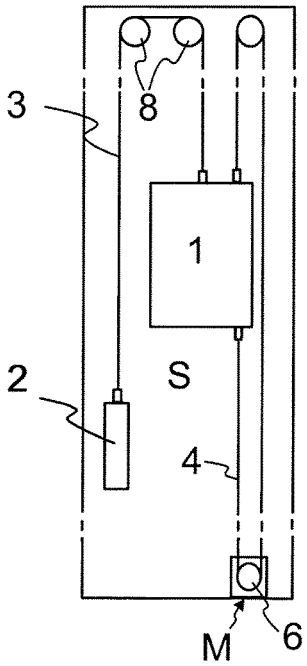
FIG. 2 presents an elevator according to a second embodiment of the invention.

FIGS. 1-8 present an elevator according to the invention, which comprises an elevator car 1, a counterweight 2 and suspension roping 3, the ropes (R1, R2) of which connect the aforementioned elevator car 1 and aforementioned counterweight 2 to each other. The elevator car 1 and the counterweight 2 are arranged to be moved by exerting a vertical force on at least the elevator car 1 or on the counterweight 2. For this purpose the elevator comprises means (M, 4; M2, R) for exerting the aforementioned force on at least the elevator car 1 or on the counterweight 2. The suspension roping 3 comprises one or more ropes (R1, R2), which comprise a load-bearing composite part 12, which comprises reinforcing fibers F in a polymer matrix M. Preferred embodiments of the structure of the rope are described later in this application. The aforementioned means (M, 4; M2, R) for moving for exerting the intended force on at least the elevator car 1 or on the counterweight 2 are separate from the suspension roping 3. In this way forces longitudinal to the composite part do not need to be exerted during a normal run of the elevator on the composite part via its outer surface. Thus detrimental shearing forces in the direction of the surface are not exerted on the composite part or on a coating possibly connected to it. Likewise, the ropes of the roping can also be suspended by bending around a rope pulley, which rope pulley does not need to be a driven rope pulley (so-called traction sheave), in which case a bend in a generally rigid rope is not great because of the machine as well as owing to its large radius. As presented the elevator comprises a rope pulley/rope pulleys 8 in the proximity of the top end of the path of movement of the elevator car 1, while supported on which rope pulley 8 the rope/ropes (R1, R2) of the suspension roping 3 support the elevator car 1 and the counterweight 2. In the embodiments presented this is implemented with a 1:1 suspension, in which case the aforementioned rope/ropes (R1, R2) of the suspension roping 3 is/are fixed at its/their first end to the elevator car 1 and at its/their second end to the counterweight 2. The suspension ratio could, however, be another, e.g. 2:1, but a 1:1 suspension ratio is advantageous because, when the rope structure comprises composite in the manner specified, making a large number of bendings is not advantageous owing to the space taken by the bendings. Preferably the rope pulley(s) 8 is/are non-driven rope pulley(s), namely in this way forces in the longitudinal direction of the rope are not exerted via the outer surface on the ropes of the roping that have composite parts. In this way also the top parts of the elevator can be formed to be spacious. It is advantageous that the rope pulley(s) 8 is/are in the elevator hoistway S, in which case a separate machine room is not needed.

In the embodiments presented in FIGS. 1-5, 7 and 8, the aforementioned means (M, 4) for exerting the aforementioned force on at least the elevator car 1 or counterweight 2 comprise traction roping 4, which is connected to the elevator car and/or to the counterweight, and a hoisting machine M, which comprises means for moving the traction roping 4, which means preferably comprise a rotating device (e.g. a motor) and a traction means 6 (preferably a traction sheave) to be rotated. The hoisting machine M is disposed in the proximity of the bottom end of the path of movement of the elevator car 1. Thus the hoisting machine M is, via the traction roping 4, in force transmission connection with the elevator car 1 and with the counterweight 2, more particularly the hoisting machine M is arranged to exert via the traction roping 6 a downward pulling force on the elevator car 1 or on the counterweight 2. In the solutions of FIGS. 1, 3, 4 and 8, the traction roping 4 is connected to the elevator car and to the counterweight, more particularly suspended to hang from the elevator car 1 and from the counterweight 2, in which case the hoisting machine M can, via the hoisting roping 4, exert either a downward pulling force on either of them whatsoever, depending on the desired direction of movement. It is not necessarily needed to connect the traction roping both to the elevator car and to the counterweight, however, but instead, as presented in FIGS. 2 and 7, when the traction roping 4 is connected to only one of these, by moving one of these (in FIG. 7 the counterweight) with the hoisting roping the other (in FIG. 7 the elevator car) is also moved, because they are in connection with each other via the suspension roping and thus their positions are dependent on each other. This can be brought about such that, as presented in FIG. 7, the hoisting machine M can, via the hoisting roping 4, exert either an upward or a downward pulling force on the counterweight 2, and correspondingly in FIG. 2 on the elevator car 1.

Figure 3:
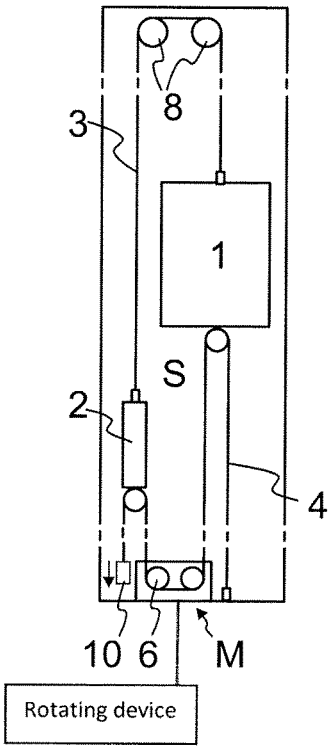
FIG. 3 presents an elevator according to a third embodiment of the invention.
Figure 4:
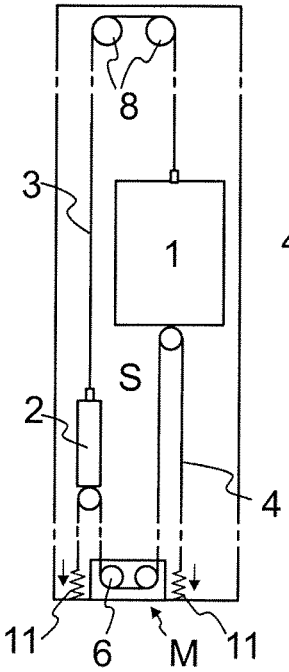
FIG. 4 presents an elevator according to a fourth embodiment of the invention.

The traction roping 4 can be different in its cross-section and/or in its material to the suspension roping 3. More particularly, the structure of the ropes of the traction roping 4 can in this case be optimized from the viewpoint of transmitting traction, e.g. friction or positive locking, and possibly of a belt, at the same time as the structure of the ropes of the suspension roping 3 can be optimized from the viewpoint of the tensile strength and rigidity and lightness of the rope. The traction roping 4 can comprise one or more ropes, which comprise a force-transmitting part or force-transmitting parts, which is a braiding/which are braidings. The rope of the traction roping 4 can thus be formed cheaply with conventional technology, and to bend with a small radius. The braiding can comprise metal fibers or e.g. aramid fibers. The rope can in this case be a braided steel rope or belt, inside which is one or more aramid braidings or steel wire braidings. The hoisting roping 4 can therefore e.g. comprise one or more ropes, the longitudinal force-transmission capability of which is based at least essentially on metal wires in the longitudinal direction of the rope, in which case preferably the traction roping 4 comprises a rope or ropes, which rope is a steel rope, or a belt, inside which belt is one or more steel braidings. The traction roping 4 can, however, be of another type. The traction roping 4 could have been connected to the counterweight and to the elevator car e.g. with a 1:1 ratio (FIGS. 1,2,7,8), in which case the elevator is simple and the rope length and overall size of the elevator can be kept small owing to the small number of components. In the embodiments presented in FIGS. 3, 4 and 5, the traction roping 4 is connected to the counterweight 2 and to the elevator car 1 with a 2:1 ratio. In this way the forces exerted on the traction roping 4 are small and the ropes can be formed to be thin and for bending with a small radius, thus making the elevator space-efficient, at least in terms of the size of the machine M and of the rope pulleys, and at the same time the speed of rotation of the machine can be adjusted to be greater than earlier, thus enabling a motor drive of smaller size as a power source of the machine M. FIGS. 3 and 4 also present one way to achieve tensioning of the traction roping, namely that a tensioning arrangement pulling the rope in the longitudinal direction is at least one or other of the ends of the ropes of the roping, for tensioning the rope and thus for ensuring adequate grip for the traction means 6 of the machine M. The tensioning arrangement 10 in FIG. 3 is a weight, which is arranged to hang from the traction roping 4 and to pull the traction roping 4 in the longitudinal direction. The tensioning arrangement 11 in FIG. 4 is a spring, which is arranged to pull the traction roping 4 in the longitudinal direction while supported on a fixed structure of the elevator, here on the floor of the elevator hoistway.

Figure 5:
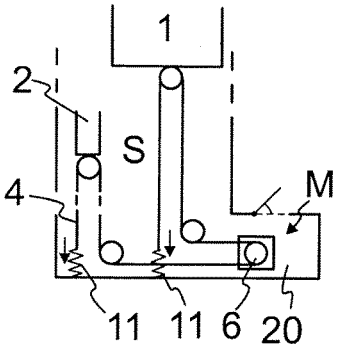
FIG. 5 presents an elevator according to a fifth embodiment of the invention.

The embodiment of FIG. 5 can correspond, with respect to the top part of the elevator, to the embodiment of FIG. 3 or 4. The hoisting machine M is disposed in a space 20 beside the elevator hoistway S in the proximity of the bottom end of the path of movement of the elevator car 1. One advantage, among others, is the ability to service the machine while standing on the floor, the ease of installing the machine of the elevator into its position, savings in actual hoistway space, and the accessibility of the machine while the elevator is running if the space is of a suitable height. In this way also laying a supply cable to the topmost floor is avoided. An access door to the space 20 is also drawn in the figure. Instead of the feature 11, a tension system of the type in FIG. 3 can be at the end or ends of the rope/ropes of the roping.

Figure 6:
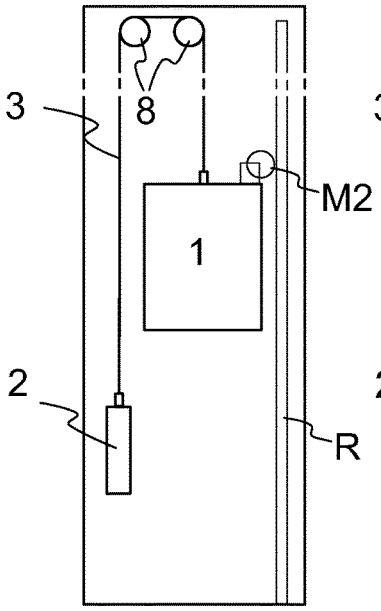
FIG. 6 presents an elevator according to a sixth embodiment of the invention.
Figure 7:
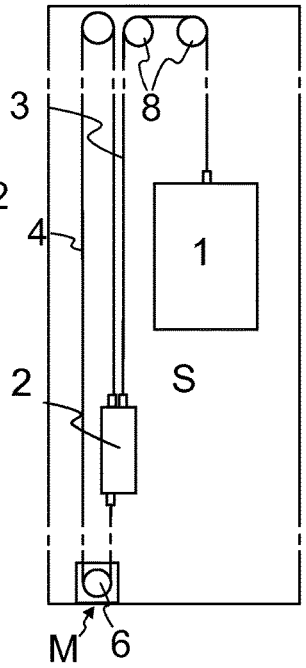
FIG. 7 presents an elevator according to a seventh embodiment of the invention.

Differing from the other embodiments presented, the solution of FIG. 6 does not require traction roping, but instead is implemented by the aid of a machine M2 in connection with the elevator car, which machine is arranged to move the car. In the solution presented, the machine M2 exerts an upward or downward force on the elevator car, depending on the prevailing state of balance. For this purpose the machine M2 takes support reaction from a counterstructure in the elevator hoistway S, which is preferably an elongated structure, along which the elevator car climbs by the aid of the machine M2. The structure can be of the so-called rack-and-pinion type, in which case a wheel rotated by the machine rests on the counterstructure. Alternatively, the structure could be realized with a so-called screw drive elevator, wherein the elevator car climbs along screw threads in the hoistway.

Figure 8:
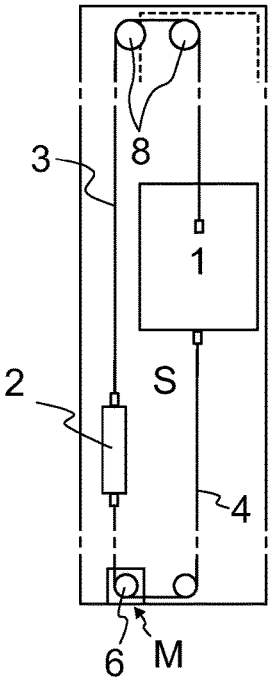
FIG. 8 presents an elevator according to an eighth embodiment of the invention.

FIG. 8 presents an embodiment, in which the rope pulley in the proximity of the top end of the path of movement of the elevator car 1, while supported on which rope pulley the rope/ropes (R1, R2) of the suspension roping 3 support the elevator car 1 and the counterweight 2, is out of the path of movement of the elevator car, and the suspension roping 3 is supported on the elevator car on the side of the elevator car 1. In this case on the side of the elevator car can be a rope clamp, or alternatively the rope can be supported on the car 1 via a diverting pulley, which diverting pulley is on the side of the elevator car with a plane of rotation in the direction of the side wall of the car, especially if the suspension ratio is 2:1. The elevator car 1 in its top position is marked in the figure with a dashed line. In its top position, i.e. when the elevator car has stopped at the topmost floor landing so that the sills of the interior and of the floor landing are face-to-face, the elevator car 1 is alongside the rope pulley 8. In this way an elevator with a shallow bottom clearance is achieved and the hoistway space is efficiently utilized. The figure presents a side view of the elevator. Preferably the elevator comprises suspension roping 3 correspondingly arranged also on the opposite side (not presented), for obtaining central support.

Figure 9:
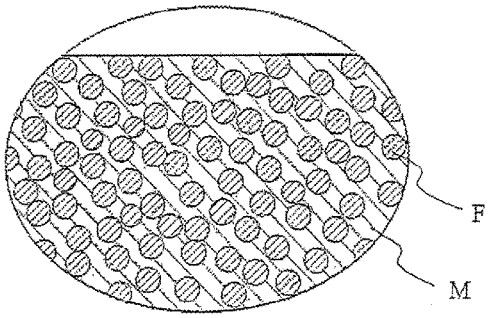
FIG. 9 presents a magnification of a part of the structure of the load-bearing part of a suspension rope of an elevator
Figure 10:
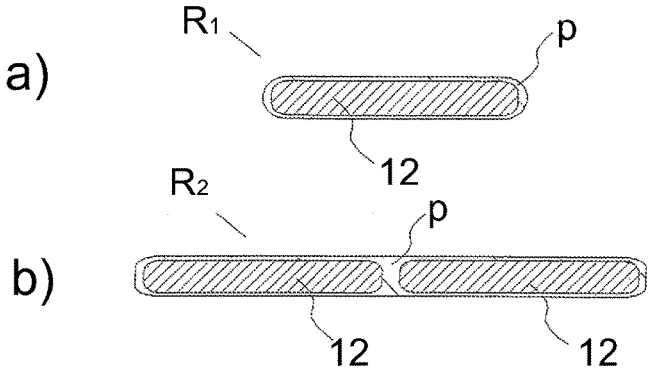
FIG. 10 presents preferred cross-sections of a suspension rope of the roping of an elevator according to the invention.

FIGS. 9-10 present some preferred cross-sections and details of a rope of the suspension roping 3 of an elevator according to the invention. As stated earlier, the suspension roping 3 comprises one or more ropes, which comprise a load-bearing composite part, which comprises reinforcing fibers in a polymer matrix. A load-bearing part means the force-transmitting part of the rope, which is a part elongated in the longitudinal direction of the rope for transmitting force in the longitudinal direction of the rope. This part is able without breaking to bear a significant part of the tensile stress in the longitudinal direction of the rope caused by the load on the rope in question, i.e. here the supporting with the rope of the elevator car and the counterweight. In the elevator presented, each (of the) load-bearing part(s) 12 of the rope(s) of the roping continues from the elevator car at least to the counterweight and the rope (R1, R2) is arranged to transmit with each aforementioned load-bearing part 12 a force in the longitudinal direction of the rope between the elevator car 1 and the counterweight 2. Thus the elevator car 1 and the counterweight 2 hang supported by the aforementioned load-bearing part/load-bearing parts.

The aforementioned load-bearing part 12 is more precisely, in terms of its material, preferably of the following type. As stated earlier, it is a composite, preferably a non-metallic composite, which comprises reinforcing fibers in a polymer matrix M. FIG. 9 presents a preferred internal structure for the load-bearing part 12. A partial cross-section of the surface structure of the load-bearing part (as viewed in the longitudinal direction of the rope) is presented inside the circle in the figure, according to which cross-section the reinforcing fibers of the load-bearing part are preferably in a polymer matrix. The figure presents how the reinforcing fibers F are essentially evenly distributed in the polymer matrix M, which surrounds the individual fibers and is fastened to the fibers. The polymer matrix M fills the areas between individual reinforcing fibers F and binds essentially all the reinforcing fibers F that are inside the matrix M to each other as an unbroken solid substance. In this case abrasive movement between the reinforcing fibers F and abrasive movement between the reinforcing fibers F and the matrix M are essentially prevented. A chemical bond exists between, preferably all, the individual reinforcing fibers F and the matrix M, one advantage of which is, inter alia, uniformity of the structure. To strengthen the chemical bond, there can be, but is not necessarily, a coating (not presented) of the actual fibers between the reinforcing fibers and the polymer matrix M, in which case the aforementioned bond to the fiber is achieved via the coating in question.

The reinforcing fibers being in the polymer matrix means here that in the invention the individual reinforcing fibers (F) are bound to each other with a polymer matrix (M), e.g. in the manufacturing phase by embedding them together in the flowing material of the polymer matrix. In this case the intervals between individual fibers bound to each other with the polymer matrix comprise the polymer of the matrix. Thus in the invention preferably a large amount of reinforcing fibers bound to each other in the longitudinal direction of the rope are distributed in the polymer matrix, being in this way evenly distributed in the force-transmitting part. The reinforcing fibers are preferably distributed essentially evenly in the polymer matrix such that the force-transmitting part is as homogeneous as possible when viewed in the direction of the cross-section of the rope. In other words, the fiber density in the cross-section of the load-bearing part does not therefore vary greatly. Thus the reinforcing fibers together with the matrix form an unbroken load-bearing part, inside which relative abrasive movement does not occur when the rope bends. The individual reinforcing fibers of the load-bearing part are mainly surrounded with the polymer matrix, but fiber-fiber contacts can occur in places because controlling the position of the fibers in relation to each other in the simultaneous impregnation with the polymer matrix is difficult, and on the other hand totally perfect elimination of random fiber-fiber contacts is not wholly necessary from the viewpoint of the functioning of the invention. If, however, it is desired to reduce their random occurrence, the individual reinforcing fibers can be pre-coated such that a polymer coating is around them already before the binding of individual reinforcing fibers to each other. In the invention the individual reinforcing fibers of the force-transmitting part can comprise material of the polymer matrix around them such that the polymer matrix is immediately against the reinforcing fiber, but alternatively a thin coating of a reinforcing fiber, e.g. a coating arranged on the surface of the reinforcing fiber in the manufacturing phase (e.g. a so-called primer) to improve chemical adhesion to the matrix material, can be in between.

The polymer matrix M can be some material suited for the purpose, e.g. some material used in connection with fiber-reinforced composite structures. The matrix M can comprise a basic polymer and, as a supplement, additives for fine-tuning the properties of, or for hardening, the matrix. The polymer matrix M is preferably a non-elastomer.

The matrix of the load-bearing part is most preferably relatively hard in its material properties, preferably at least essentially harder than rubber. A hard matrix helps to support the reinforcing fibers, especially when the rope bends, preventing buckling of the reinforcing fibers of the bent rope, because the hard material supports the fibers. To reduce the bending radius of the rope, among other things, it is for this reason advantageous that the polymer matrix is hard, and therefore something other than an elastomer (an example of an elastomer: rubber) or something else that behaves very elastically or gives way. The most preferred materials of the matrix are epoxy, polyester, phenolic plastic and vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. In this case the behavior in bending is most advantageous. The matrix of the composite, in which matrix the individual fibers are distributed as evenly as possible, is most preferably epoxy resin or formed to comprise epoxy resin, which has good adhesion to the reinforcing fibers and which is strong, behaving advantageously more particularly with glass fiber and carbon fiber. Alternatively, e.g. polyester or vinyl ester can be used.

Preferably over 50% of the surface area of the cross-section of the load-bearing part is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix. Most preferably such that approx. 60% of the surface area is reinforcing fiber and approx. 40% is matrix material (preferably epoxy). In this way a good longitudinal strength of the rope is achieved. When the force-transmitting part is of a composite comprising non-metallic reinforcing fibers, the aforementioned force-transmitting part is an unbroken, elongated, rigid piece. One advantage, among others, is that it returns to its shape from a bent position to be straight. In this case the structure does not essentially surrender energy in bending.

Preferably the aforementioned reinforcing fibers F are non-metallic fibers, thus being light fibers. Preferably the aforementioned reinforcing fibers F are carbon fibers, glass fibers, aramid fibers or polymer fibers (preferably polybenzoxazole fibers or polyethylene fibers, such as UHMWPE fibers, or nylon fibers, which are all lighter than metal fibers). The reinforcing fibers of the load-bearing part can comprise one of these (e.g. carbon fibers on their own) or can be a combination of these fibers (e.g. carbon fibers and glass fibers or carbon fibers and polyethylene fibers, et cetera). The reinforcing fibers can be a combination of fibers, which combination preferably comprises at least one of these fibers. Most preferably the aforementioned reinforcing fibers F are carbon fibers or glass fibers, which are light, and they possess good strength properties and rigidity properties and at the same time they still tolerate very high temperatures, which is important in elevators because poor heat tolerance of the hoisting ropes might cause damage or even ignition of the hoisting ropes, which is a safety risk. Good thermal conductivity also assists the onward transfer of heat due to friction, among other things, and thus reduces the accumulation of heat in the parts of the rope. More particularly the properties of carbon fiber are advantageous in elevator use. The properties of glass fiber are also sufficiently good for many elevators and glass fibers are cheap in price.

The aforementioned reinforcing fibers F are most preferably e.g. synthetic fibers, the density of which is less than 4000 kg/m3, thus it is possible to form the rope to be essentially lighter than steel ropes according to prior art. More precisely, preferably the density of the fibers F is less than 4000 kg/m3, and the strength is over 1500 N/mm2, more preferably so that the density of the aforementioned fibers F is less than 4000 kg/m3, and the strength is over 2500 N/mm2, most preferably so that the density of the aforementioned fibers F is less than 3000 kg/m3, and the strength is over 3000 N/mm2. One advantage is that the fibers are light, and not many of them are needed owing to their great strength. The aforementioned strength is understood with brittle materials to mean breaking strength and with other materials to mean yield strength. Alternatively, other than the aforementioned reinforcing fibers can be used, e.g. selecting as a reinforcing fiber some commercially available reinforcing fibers. It is advantageous in this case to select the fibers according to the aforementioned limits.

The aforementioned rope of the suspension roping can comprise one or more load-bearing composite parts 12, the preferred structure of which has been described in the preceding. The cross-section of the rope is preferably according to any of those presented in FIGS. 10*a*-10*b*. As presented in the figures, the rope R1, R2 of the elevator according to the invention is most preferably belt-shaped. Its width/thickness ratio is preferably at least 2 or more, preferably at least 4, even more preferably at least 5 or more, even more preferably at least 6, even more preferably at least 7 or more, even more preferably at least 8 or more, most preferably of all more than 10. In this way a large cross-sectional area for the rope is achieved, the bending capacity of the thickness direction of which is good around the lengthwise axis also with rigid materials of the force-transmitting part. Additionally, preferably the aforementioned load-bearing part 12 or plurality of load-bearing parts 12 together cover most of the width of the cross-section of the rope R1, R2 for essentially the whole length of the rope. Preferably the load-bearing part(s) 12 thus cover(s) 60% or over, more preferably 65% or over, more preferably 70% or over, more preferably 75% or over, most preferably 80% or over, most preferably 85% or over, of the width of the cross-section of the rope. Thus the supporting capacity of the rope with respect to its total lateral dimensions is good, and the rope does not need to be formed to be thick. This can be simply implemented with any of the aforementioned materials, with which the thinness of the rope is particularly advantageous from the standpoint of, among other things, service life and bending rigidity. When the rope comprises a plurality of load-bearing parts 12, the aforementioned plurality of load-bearing parts 12 is formed from a plurality of load-bearing parts 12 that are parallel in the width direction of the rope and are on at least essentially the same plane. Thus their resistance to bending when bending the rope in the thickness direction is small.

The width of the aforementioned load-bearing part 12 is preferably greater than the thickness. In this case preferably such that the width/thickness of the aforementioned load-bearing part 12 is at least 2 or more, preferably at least 3 or more, even more preferably at least 4 or more, even more preferably at least 5, most preferably of all more than 5. In this way a large cross-sectional area for the load-bearing part/parts is achieved, the bending capacity of the thickness direction of which is good around the axis of the width direction also with rigid materials of the load-bearing part. The bending direction of the rope is in this case around the axis of the width direction of the rope (up or down in the figure).

The aforementioned load-bearing part 12 or plurality of load-bearing parts 12 can be surrounded with a polymer layer p in the manner presented in FIGS. 10*a*-10*b*, which coating p is preferably an elastomer, most preferably a high-friction elastomer such as preferably polyurethane, which layer forms the surface of the rope. Alternatively one load-bearing part 12 could form a rope on its own, with or without a polymer layer p. When the coating layer is thin, as it is in the case of the embodiments presented, the force transmission to the elevator car presented is advantageous because keeping a thin coating attached to the composite would be jeopardized as a consequence of the repeated force transmission in the longitudinal direction of the rope exerted via the surface. More particularly, it can be awkward to achieve good adhesion to the composite part, because it is difficult to form the surface of the composite part to be adhesive in shape. For reasons of manufacturing technology the surface of the composite part is easily smooth.

The reinforcing fibers F are preferably long continuous fibers preferably at least essentially longitudinal to the rope, which fibers preferably continue for the distance of the whole length of the rope. The reinforcing fibers are preferably essentially uninterlaced in relation to each other. Thus the structure of the load-bearing part can be made to continue with as far as possible the same cross-sectional shape for the whole distance of the rope. Preferably the reinforcing fibers F are as longitudinal as possible to the rope, for which reason the rope retains its structure when bending, namely also the load-bearing part 12 is in the longitudinal direction of the rope R1, R2. When the individual reinforcing fibers are longitudinal to the rope they are in the direction of the force when the rope is pulled, and shape deformation in addition to possible elongation does not really occur. Preferably as many fibers as possible, most preferably essentially all the reinforcing fibers of the aforementioned load-bearing part are in the longitudinal direction of the rope. The aforementioned reinforcing fibers F are bound into an unbroken force-transmitting part with the aforementioned polymer matrix, in which case the load-bearing part 12 can be one unbroken elongated rod-like piece. For facilitating the formation of the load-bearing part and for achieving constant properties in the longitudinal direction it is advantageous that the structure of the load-bearing part 2 continues essentially the same for the whole length of the rope. For the same reasons, the structure of the rope continues preferably essentially the same for the whole length of the rope.

The load-bearing part 12 or the aforementioned plurality of load-bearing parts 12 of the rope R1, R2 of the elevator according to the invention is preferably fully of non-metallic material. Thus the rope is light. (The load-bearing parts could, however, if necessary be formed to comprise individual metal wires for another purpose than force transmission in the longitudinal direction, for instance in a condition monitoring purpose, but such that their aggregated force-transmission capability does not form an essential part of the force-transmission capability of the rope.) The rope can comprise one load-bearing part of the aforementioned type, or a plurality of them, in which case this plurality of load-bearing parts 12 is formed from a plurality of parallel force-transmitting parts 12. The aforementioned force-transmitting part 12 alone, or the plurality of load-bearing parts together, covers over 40% of the surface area of the cross-section of the rope R1, R2, preferably 50% or over, even more preferably 60% or over, even more preferably 65% or over. In this way a large cross-sectional area is achieved for the load-bearing part/parts of the rope, and an advantageous capability for transferring forces.

An advantage of the composite structure presented is that the matrix M surrounding the reinforcing fibers F keeps the interpositioning of the reinforcing fibers F essentially unchanged. It equalizes with its slight elasticity the distribution of a force exerted on the fibers, reduces fiber-fiber contacts and internal wear of the rope, thus improving the service life of the rope. The reinforcing fibers can be glass fibers, in which case good electrical insulation and an inexpensive price, among other things, are achieved. In this case also the tensile rigidity of the rope is slightly lower, so that rope pulleys of small diameter can be used for bending the rope. Alternatively the reinforcing fibers can be of carbon fiber, in which case good tensile rigidity and a light structure and good thermal properties, among other things, are achieved.

The cross-section and possibly the structure of the rope otherwise can be of any of the types presented in application WO 2009090299. Although the rope of the invention is preferably belt-shaped, the invention could, however, also be utilized with other cross-sectional shapes of the rope or of its load-bearing part.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. Elevator, comprising:

an elevator car;

a counterweight;

a suspension roping, which connects the elevator car and counterweight to each other, and comprises one or more ropes, each rope comprising a load-bearing composite part, which comprises reinforcing fibers in a polymer matrix;

a traction roping connected to the elevator car and the counterweight by being suspended to hang from the elevator car and from the counterweight; and a motorized traction device separate from the suspension roping and configured to exert a vertical force on at least the elevator car or on the counterweight via the traction roping, wherein the elevator car and the counterweight are arranged to be moved by exerting the vertical force on at least the elevator car or on the counterweight, and wherein the traction roping includes a first portion suspended by the elevator car and a second portion suspended by the counterweight, and a suspension ratio of the first portion of the traction roping and the second portion of the traction roping is 2:1.

2. The elevator according to claim 1, wherein the motorized traction device comprises a rotating device and a traction sheave to be rotated.

3. The elevator according to claim 2, wherein a module of elasticity of the aforementioned polymer matrix is at least 2 GPa.

4. The elevator according to claim 2, wherein the elevator comprises a rope pulley, while supported on which the one or more ropes of the suspension roping support the elevator car and the counterweight.

5. The elevator according to claim 1, wherein a module of elasticity of the polymer matrix is at least 2 GPa.

6. The elevator according to claim 5, wherein the elevator comprises a rope pulley, while supported on which the one or more ropes of the suspension roping support the elevator car and the counterweight.

7. The elevator according to claim 1, wherein the elevator comprises a rope pulley, while supported on which the one or more ropes of the suspension roping support the elevator car and the counterweight.

8. The elevator according to claim 7, wherein the rope pulley is a non-driven rope pulley.

9. The elevator according to claim 8, wherein the rope pulley is out of a path of movement of the elevator car, and the suspension roping is supported on the side of the elevator car.

10. The elevator according to claim 7, wherein the rope pulley is out of a path of movement of the elevator car, and the suspension roping is supported on the side of the elevator car.

11. The elevator according to claim 1, wherein a density of the reinforcing fibers is less than 4000 kg/m3.

12. The elevator according to claim 1, wherein a strength of the reinforcing fibers is over 1500 N/mm2.

13. The elevator according to claim 1, wherein the reinforcing fibers are carbon fibers, glass fibers, aramid fibers or polymer fibers, or a number of different types of fibers, comprising at least one or more of the carbon fibers, glass fibers, aramid fibers and polymer fibers.

14. The elevator according to claim 1, wherein the reinforcing fibers are carbon fibers or glass fibers or a number of different types of fibers, comprising at least glass fibers or carbon fibers.

15. The elevator according to claim 1, wherein the reinforcing fibers are essentially uninterlaced with each other.

16. The elevator according to claim 1, wherein the individual reinforcing fibers are evenly distributed in the aforementioned matrix.

17. The elevator according to claim 1, wherein the hoisting machine is disposed in a proximity of a bottom end of a path of movement of the elevator car.

18. The elevator according to claim 1, wherein the traction roping comprises one or more ropes, a longitudinal force-transmission capability of which is based at least essentially on metal wires in a longitudinal direction of the one or more ropes of the traction roping.

19. The elevator according to claim 1, wherein the load-bearing part is surrounded with a coating layer, and the coating layer forms the surface of the rope.

* * * * *